US012276216B2

(12) United States Patent
Nogami et al.

(10) Patent No.: US 12,276,216 B2
(45) Date of Patent: Apr. 15, 2025

(54) CYLINDER HEAD BLANK AND CYLINDER HEAD MANUFACTURING METHOD

(71) Applicant: NISSAN MOTOR CO., LTD., Yokohama (JP)

(72) Inventors: Moriyuki Nogami, Kanagawa (JP); Masatoshi Inoguchi, Kanagawa (JP); Hidenobu Matsuyama, Kanagawa (JP); Hirohisa Shibayama, Kanagawa (JP); Yoshitsugu Noshi, Kanagawa (JP); Koukichi Kamada, Kanagawa (JP); Naoya Tainaka, Kanagawa (JP)

(73) Assignee: NISSAN MOTOR CO., LTD., Yokohama (JP)

( * ) Notice: Subject to any disclaimer, the term of this patent is extended or adjusted under 35 U.S.C. 154(b) by 0 days.

(21) Appl. No.: 18/032,772

(22) PCT Filed: Oct. 21, 2020

(86) PCT No.: PCT/JP2020/039607
§ 371 (c)(1),
(2) Date: Apr. 19, 2023

(87) PCT Pub. No.: WO2022/085130
PCT Pub. Date: Apr. 28, 2022

(65) Prior Publication Data

US 2023/0399961 A1 Dec. 14, 2023

(51) Int. Cl.

| | |
|---|---|
| ***F01L 3/00*** | (2006.01) |
| ***B22F 5/00*** | (2006.01) |
| ***F01L 3/04*** | (2006.01) |

(52) U.S. Cl.
CPC ..... *F01L 3/04* (2013.01); *B22F 5/008* (2013.01); *F01L 2303/00* (2020.05)

(58) Field of Classification Search
CPC ..... C23C 24/04; C23C 24/085; C23C 24/103; F01L 3/04; F01L 2303/00; Y10T 29/49306
USPC ..... 123/188.1
See application file for complete search history.

(56) References Cited

U.S. PATENT DOCUMENTS 4,723,518 A * 2/1988 Kawasaki ..... F02B 77/02 123/188.8
5,778,531 A * 7/1998 Inami ..... F01L 3/22 123/188.8
6,017,591 A * 1/2000 Popoola ..... F02F 1/4214 427/455

(Continued)

FOREIGN PATENT DOCUMENTS

JP S58-146805 U 10/1983
JP 07-138736 A 5/1995

(Continued)

*Primary Examiner* — Long T Tran
*Assistant Examiner* — James J Kim
(74) *Attorney, Agent, or Firm* — Foley & Lardner LLP

(57) ABSTRACT

A film formation portion is formed on an annular edge portion along an opening portion (16*a*) of an intake port (16) or an opening portion (17*a*) of an exhaust port (17). The cross section, along the radial direction of the intake port (16) or the exhaust port (17), of the film formation portion, on which a metal film (5) is formed by spraying a raw material powder using a cold spray method, is formed in a groove shape that includes a flat bottom surface (G1) and a pair of side surfaces (G2) adjacent to the bottom surface.

8 Claims, 13 Drawing Sheets

(56) References Cited

U.S. PATENT DOCUMENTS

| | | | | |
|---|---|---|---|---|
| 11,446,765 | B2 * | 9/2022 | Aoyama | B23K 26/0869 |
| 2007/0101964 | A1 * | 5/2007 | Morimoto | B22F 5/008 123/188.8 |
| 2015/0285109 | A1 * | 10/2015 | Hoeg | F01L 3/02 148/559 |
| 2018/0223902 | A1 * | 8/2018 | Izawa | F01L 3/04 |
| 2018/0272471 | A1 | 9/2018 | Aoyama et al. | |
| 2018/0272472 | A1 * | 9/2018 | Aoyama | F02M 61/18 |
| 2020/0011211 | A1 | 1/2020 | Izawa et al. | |
| 2022/0042177 | A1 | 2/2022 | Shibayama et al. | |

FOREIGN PATENT DOCUMENTS

| | | | |
|---|---|---|---|
| JP | 2004-034141 | A | 2/2004 |
| JP | 2009-197276 | A | 9/2009 |
| JP | 2010-223013 | A | 10/2010 |
| JP | 2018-123401 | A | 8/2018 |
| JP | 2018-158347 | A | 10/2018 |
| JP | 2020-012442 | A | 1/2020 |
| WO | WO-2017/022505 | A1 | 2/2017 |
| WO | WO-2019/038974 | A1 | 2/2019 |
| WO | WO-2020/059003 | A1 | 3/2020 |

* cited by examiner

CYLINDER HEAD BLANK AND CYLINDER HEAD MANUFACTURING METHOD

TECHNICAL FIELD

The present invention relates to a semimanufactured cylinder head (cylinder head blank) used in an internal-combustion engine and a method of manufacturing a cylinder hear.

BACKGROUND ART

A method of manufacturing sliding members is known, which includes spraying a raw material powder such as metal powder onto the seating portions for engine valves using a cold spray method thereby to form valve seats having excellent high-temperature wear resistance (Patent Document 1).

PRIOR ART DOCUMENT

Patent Document

[Patent Document 1] WO2017/022505

SUMMARY OF INVENTION

Problems to be Solved by Invention

Unfortunately, however, the valve seats of an engine have a problem in that the valve seat films formed by the cold spray method may crack or delaminate due to impact caused by striking input of intake and exhaust valves or wear due to repeated collisions.

A problem to be solved by the present invention is to provide a semimanufactured cylinder head equipped with valve seat films having excellent interfacial adhesion and high strength and a method of manufacturing a cylinder head.

Means for Solving Problems

The present invention solves the above problem by forming the cross section of a film formation portion along the radial direction into a groove shape including a flat bottom surface and a pair of side surfaces adjacent to the bottom surface. The film formation portion is to be sprayed with a raw material powder by using a cold spray method to form a film.

Effect of Invention

According to the present invention, the compressive residual stress of a metal film formed on the film formation portion by using a cold spray method acts on the pair of side surfaces of the groove shape of the film formation portion, and it is therefore possible to manufacture a cylinder head equipped with the metal film having excellent interfacial adhesion and high strength.

MODE(S) FOR CARRYING OUT THE INVENTION

Figure 1:
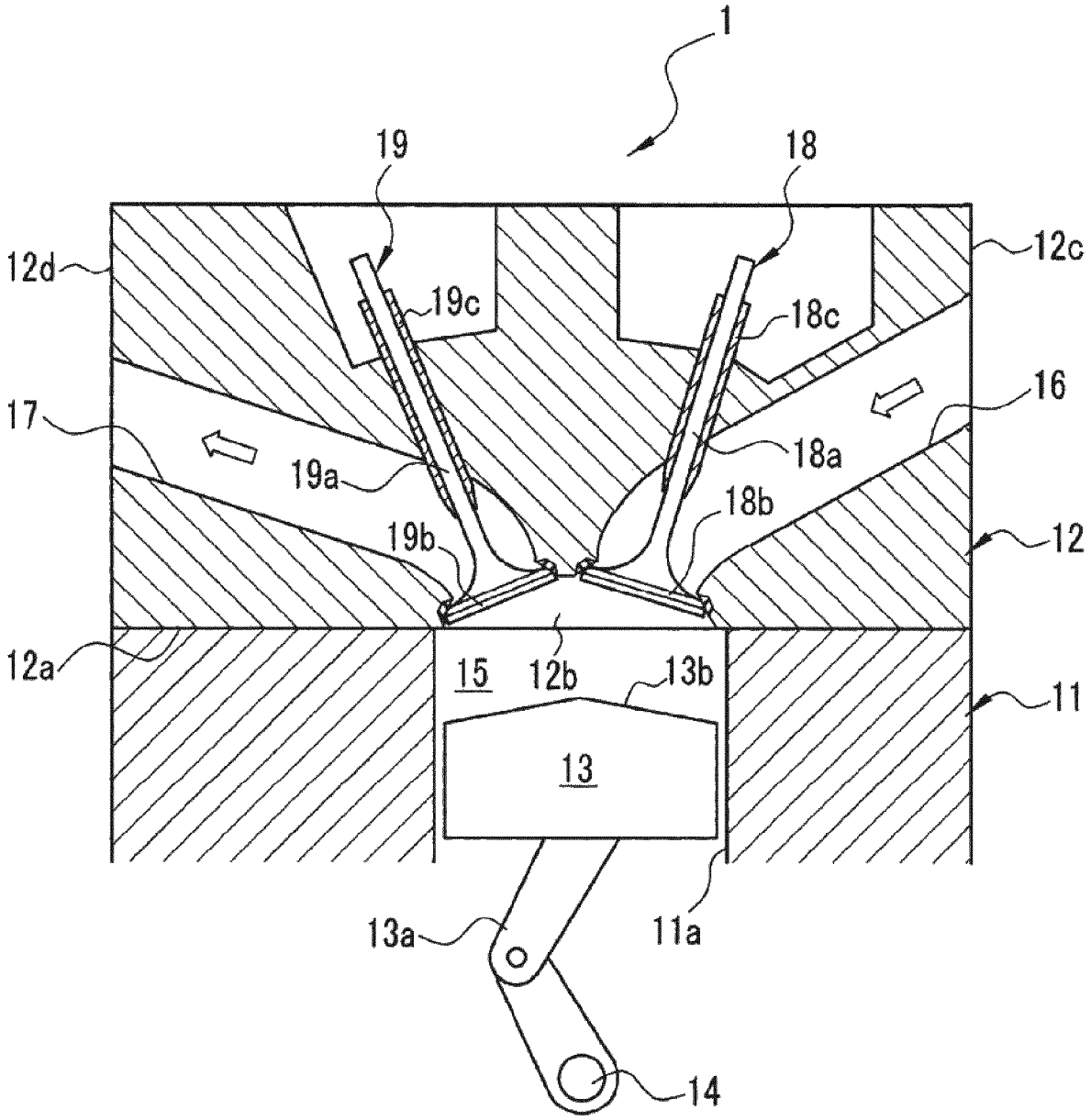
FIG. 1 is a cross-sectional view illustrating the configuration of an internal-combustion engine equipped with a cylinder head that is manufactured by using the semimanufactured cylinder head according to the present invention with the manufacturing method according to the present invention.

Hereinafter, an embodiment of the present invention will be described with reference to the drawings. First, the description will be directed to an internal-combustion engine 1 equipped with a cylinder head that is manufactured by using a semimanufactured cylinder head according to the present invention with a manufacturing method according to the present invention. FIG. 1 is a cross-sectional view of the internal-combustion engine 1 and mainly illustrates the configuration around the cylinder head.

The internal-combustion engine 1 includes a cylinder block 11 and a cylinder head 12 that is mounted on the upper portion of the cylinder block 11. The internal-combustion engine 1 is, for example, an in-line four-cylinder gasoline engine, and the cylinder block 11 has four cylinders 11*a* arranged in the depth direction of the drawing sheet. The cylinders 11*a* house respective pistons 13 that reciprocate in the vertical direction in the figure. Each piston 13 is connected to a crankshaft 14, which extends in the depth direction of the drawing sheet, via a connecting rod 13*a*.

The cylinder head 12 has a mounting surface 12*a* for being mounted on the cylinder block 11. The mounting surface 12*a* is formed with four recessed portions 12*b* at positions corresponding to respective cylinders 11*a*. The recessed portions 12*b* define combustion chambers 15 of the cylinders. Each combustion chamber 15 is a space for combusting a mixture gas of fuel and intake air and is defined by a recessed portion 12*b* of the cylinder head 12, a top surface 13*b* of the piston 13, and an inner surface of the cylinder 11*a*.

The cylinder head 12 includes intake ports 16 that connect between the combustion chambers 15 and one side surface 12*c* of the cylinder head 12. The intake ports 16 have a curved, approximately cylindrical shape and guide intake air from an intake manifold (not illustrated) connected to the side surface 12*c* into respective combustion chambers 15. The cylinder head 12 further includes exhaust ports 17 that connect between the combustion chambers 15 and the other side surface 12*d* of the cylinder head 12. The exhaust ports 17 have a curved, approximately cylindrical shape like the intake ports 16 and exhaust the exhaust gas generated in respective combustion chambers 15 to an exhaust manifold (not illustrated) connected to the side surface 12*d*. In the internal-combustion engine 1 according to the present embodiment, one cylinder 11*a* is provided with two intake ports 16 and two exhaust ports 17.

The cylinder head 12 is provided with intake valves 18 that open and close the intake ports 16 with respect to the combustion chambers 15 and exhaust valves 19 that open and close the exhaust ports 17 with respect to the combustion chambers 15. Each intake valve 18 includes a round rod-shaped valve stem 18*a* and a disk-shaped valve head 18*b* that is provided at the tip of the valve stem 18*a*. Likewise, each exhaust valve 19 includes a round rod-shaped valve stem 19*a* and a disk-shaped valve head 19*b* that is provided at the tip of the valve stem 19*a*. The valve stems 18*a* and 19*a* are slidably inserted into approximately cylindrical valve guides 18*c* and 19*c*, respectively. This allows the intake valves 18 and the exhaust valves 19 to be movable along the axial directions of the valve stems 18*a* and 19*a*, respectively, with respect to the combustion chambers 15.

Figure 2:
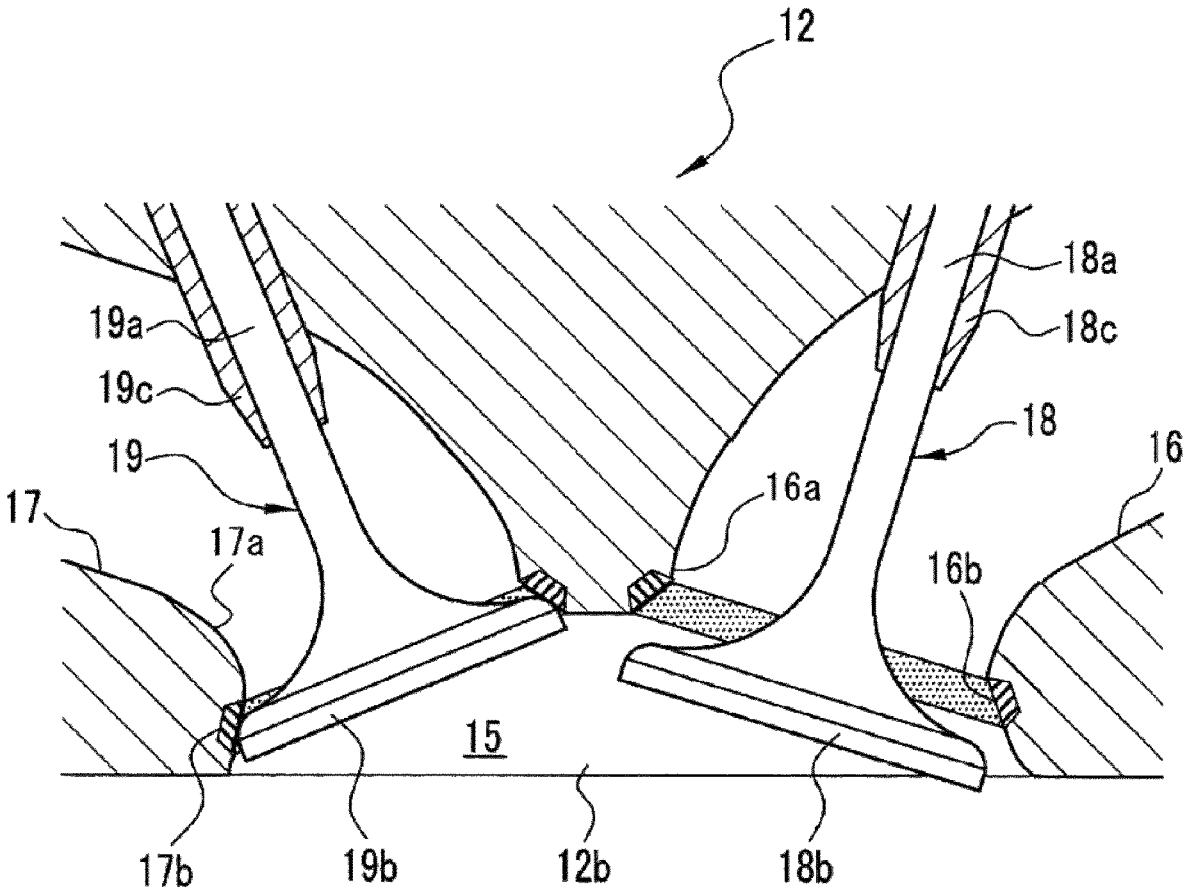
FIG. 2 is an enlarged cross-sectional view around valves of FIG. 1.

FIG. 2 is an enlarged view illustrating a portion in which a combustion chamber 15 communicates with an intake port 16 and an exhaust port 17. The intake port 16 includes an approximately circular opening portion 16*a* at the portion communicating with the combustion chamber 15. The opening portion 16*a* has an annular edge portion (seat portion for valve) formed with an annular valve seat film 16*b* that can abut against the valve head 18*b* of an intake valve 18. When the intake valve 18 moves upward along the axial direction of the valve stem 18*a*, the upper surface of the valve head 18*b* abuts against the valve seat film 16*b* to close the intake port 16. Conversely, when the intake valve 18 moves downward along the axial direction of the valve stem 18*a*, a gap is formed between the upper surface of the valve head 18*b* and the valve seat film 16*b* to open the intake port 16.

Like the intake port 16, the exhaust port 17 includes an approximately circular opening portion 17*a* at the portion communicating with the combustion chamber 15, and the opening portion 17*a* has an annular edge portion (seat portion for valve) formed with an annular valve seat film 17*b* that can abut against the valve head 19*b* of an exhaust valve 19. When the exhaust valve 19 moves upward along the axial direction of the valve stem 19*a*, the upper surface of the valve head 19*b* abuts against the valve seat film 17*b* to close the exhaust port 17. Conversely, when the exhaust valve 19 moves downward along the axial direction of the valve stem 19*a*, a gap is formed between the upper surface of the valve head 19*b* and the valve seat film 17*b* to open the exhaust port 17. The diameter of the opening portion 16*a* of the intake port 16 is set larger than the diameter of the opening portion 17*a* of the exhaust port 17.

The internal-combustion engine 1 is a four-cycle engine, in which only the intake valve 18 opens when the corresponding piston 13 moves down, and the mixture gas is thereby introduced from the intake port 16 into the cylinder 11*a* (intake stroke). Subsequently, the intake valve 18 and the exhaust valve 19 are brought into the closed state, and the piston 13 is moved up to almost the top dead center to compress the mixture gas in the cylinder 11*a* (compression stroke). Then, when the piston 13 reaches almost the top dead center, the compressed mixture gas is ignited by a spark plug to explode. This explosion makes the piston 13 move down to the bottom dead center and is converted into the rotational force via the connected crankshaft 14 (combustion/expansion stroke). Finally, when the piston 13 reaches the bottom dead center and starts moving up again, only the exhaust valve 19 is opened to exhaust the exhaust gas in the cylinder 11*a* to the exhaust port 17 (exhaust stroke). The internal-combustion engine 1 repeats the above cycle to generate the output.

The opening portions 16*a* and 17*a* of the cylinder head 12 have respective annular edge portions, or seat portions for valves, and the valve seat films 16*b* and 17*b* are formed directly on the annular edge portions by using a cold spray method. The cold spray method refers to a method that includes making a supersonic flow of an operation gas having a temperature lower than the melting point or softening point of a raw material powder, injecting the raw material powder carried by a carrier gas into the operation gas to spray the raw material powder from a nozzle tip, and causing the raw material powder in the solid phase state to collide with a base material to form a film by plastic deformation of the raw material powder. Compared with a thermal spray method in which the material is melted and deposited on a base material, the cold spray method has features that a dense film can be obtained without oxidation in the air, thermal alteration is suppressed because of less thermal effect on the material particles, the film formation speed is high, the film can be made thick, and the deposition efficiency is high. In particular, the cold spray method is suitable for the use for structural materials such as the valve seat films 16*b* and 17*b* of the internal-combustion engine 1 because the film formation speed is high and the films can be made thick.

Figure 3:
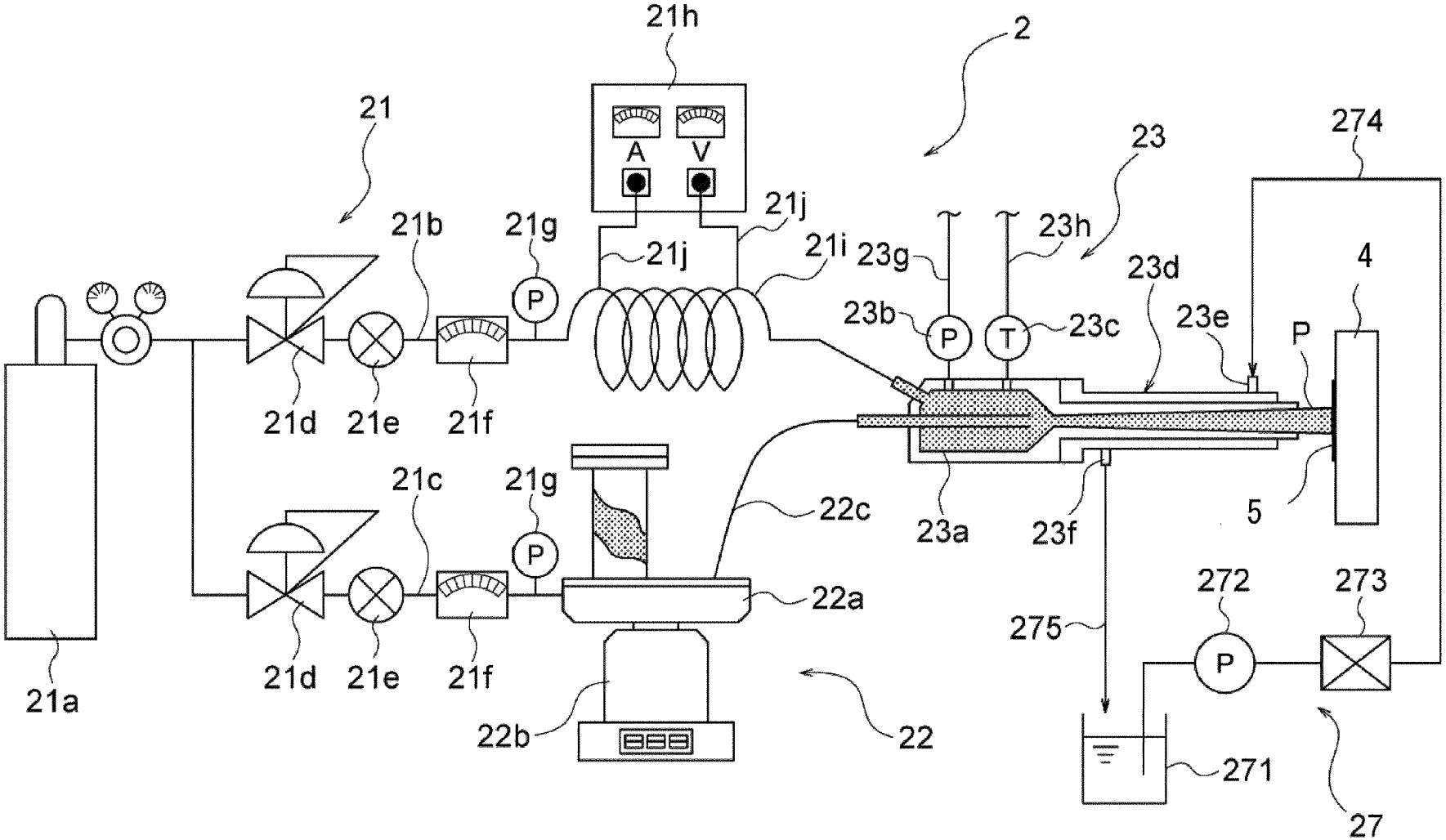
FIG. 3 is a configuration diagram of a cold spray apparatus used in the method of manufacturing a cylinder head according to the present invention.

FIG. 3 is a diagram schematically illustrating a cold spray apparatus 2 used for forming the above valve seat films 16*b* and 17*b*. The cold spray apparatus 2 of this example includes a gas supply unit 21 that supplies an operation gas and a carrier gas, a raw material powder supply unit 22 that supplies a raw material powder of the valve seat films 16*b* and 17*b*, a spray gun 23 that sprays the raw material powder as a supersonic flow using the operation gas having a temperature equal to or lower than the melting point of the raw material powder, and a coolant circulation circuit 27 that cools a nozzle 23*d*.

The gas supply unit 21 includes a compressed gas cylinder 21*a*, an operation gas line 21*b*, and a carrier gas line 21*c*. Each of the operation gas line 21*b* and the carrier gas line 21*c* includes a pressure regulator 21*d*, a flow rate control valve 21*e*, a flow meter 21*f*, and a pressure gauge 21*g*. The pressure regulators 21*d*, the flow rate control valves 21*e*, the flow meters 21*f*, and the pressure gauges 21*g* are used for adjusting the pressure and flow rate of each of the operation gas and carrier gas from the compressed gas cylinder 21*a*.

The operation gas line 21*b* is installed with a heater 21*i* such as a tape heater, and the heater 21*i* heats the operation gas line 21*b* by being supplied with power from a power source 21*h* through power supply lines 21*j* and 21*j*. The operation gas is heated by the heater 21*i* to a temperature lower than the melting point or softening point of the raw material powder and then introduced into a chamber 23*a* of the spray gun 23. The chamber 23*a* is installed with a pressure gauge 23*b* and a thermometer 23*c* that have a signal lines 23*g* and 23*h*, respectively, and the detected pressure value and temperature value are output to a controller (not illustrated) via the signal lines 23*g* and 23*h* and are used for feedback control of the pressure and temperature.

On the other hand, the raw material powder supply unit 22 includes a raw material powder supply device 22*a*, which is provided with a weighing machine 22*b* and a raw material powder supply line 22*c*. The carrier gas from the compressed gas cylinder 21*a* is introduced into the raw material powder supply device 22*a* through the carrier gas line 21*c*. A predetermined amount of the raw material powder weighed by the weighing machine 22*b* is carried into the chamber 23*a* via the raw material powder supply line 22*c*.

The spray gun 23 sprays the raw material powder P, which is carried into the chamber 23*a* by the carrier gas, together with the operation gas as the supersonic flow from the tip of the nozzle 23*d* and causes the raw material powder P in the solid phase state or solid-liquid coexisting state to collide with a base material 4 to form a metal film 5. In the present embodiment, the cylinder head 12 is applied as the base material 4, and the raw material powder P is sprayed onto the annular edge portions of the opening portions 16*a* and 17*a* of the cylinder head 12 by using the cold spray method to form the valve seat films 16*b* and 17*b* as metal films 5.

The nozzle 23*d* has a flow channel (not illustrated) through which a coolant such as water flows. The tip of the nozzle 23*d* is provided with a coolant introduction port 23*e* through which the coolant is introduced into the flow channel, and the base end of the nozzle 23*d* is provided with a coolant discharge port 23*f* through which the coolant in the flow channel is discharged. The nozzle 23*d* is cooled through introducing the coolant into the flow channel from the coolant introduction port 23*e*, flowing the coolant in the flow channel, and discharging the coolant from the coolant discharge port 23*f*.

The coolant circulation circuit 27 which circulates the coolant through the flow channel of the nozzle 23*d* includes a tank 271 that stores the coolant, an introduction pipe 274 that is connected to the above-described coolant introduction port 23*e*, a pump 272 that is connected to the introduction pipe 274 and flows the coolant between the tank 271 and the nozzle 23*d*, a cooler 273 that cools the coolant, and a discharge pipe 275 that is connected to the coolant discharge port 23*f*. The cooler 273 is composed, for example, of a heat exchanger or the like and cools the coolant by exchanging heat between the coolant whose temperature is increased by cooling the nozzle 23*d* and a refrigerant such as air, water, or gas.

The coolant circulation circuit 27 vacuums up the coolant stored in the tank 271 using the pump 272 and supplies the coolant to the coolant introduction port 23*e* via the cooler 273. The coolant supplied to the coolant introduction port 23*e* flows through the flow channel in the nozzle 23*d* from the tip side toward the rear end side while exchanging heat with the nozzle 23*d* to cool it. The coolant flowed to the rear end side of the flow channel is discharged from the coolant discharge port 23*f* to the discharge pipe 275 and returns to the tank 271. Thus, the coolant circulation circuit 27 cools the nozzle 23*d* by circulating the coolant while cooling it, and it is therefore possible to suppress the adhesion of the raw material powder P to the injection passage of the nozzle 23*d*.

The valve seats of the cylinder head 12 are required to have high heat resistance and wear resistance that can withstand the striking input from the valves in the combustion chambers 15, and also required to have high heat conductivity for cooling the combustion chambers 15. In response to these requirements, according to the valve seat films 16*b* and 17*b* formed of the powder of precipitation-hardened copper alloy, for example, the valve seats can be obtained which are excellent in the heat resistance and wear resistance and harder than the cylinder head 12 formed of an aluminum alloy for casting.

Moreover, the valve seat films 16*b* and 17*b* are formed directly on the cylinder head 12, and higher heat conductivity can therefore be obtained as compared with conventional valve seats formed by press-fitting seat rings as separate components into the port opening portions. Furthermore, as compared with the case in which the seat rings as separate components are used, subsidiary effects can be obtained such as that the valve seats can be made close to a water jacket for cooling and the tumble flow can be promoted due to expansion of the throat diameter of the intake ports 16 and exhaust ports 17 and optimization of the port shape.

The raw material powder P used for forming the valve seat films 16*b* and 17*b* is preferably a powder of metal that is harder than an aluminum alloy for casting and with which the heat resistance, wear resistance, and heat conductivity required for the valve seats can be obtained. For example, it is preferred to use the above-described precipitation-hardened copper alloy. The precipitation-hardened copper alloy for use may be a Corson alloy that contains nickel and silicon, chromium copper that contains chromium, zirconium copper that contains zirconium, or the like. It is also possible to apply, for example, a precipitation-hardened copper alloy that contains nickel, silicon, and chromium, a precipitation-hardened copper alloy that contains nickel, silicon, and zirconium, a precipitation-hardened copper alloy that contains nickel, silicon, chromium, and zirconium, a precipitation-hardened copper alloy that contains chromium and zirconium, or the like.

The valve seat films 16*b* and 17*b* may also be formed by mixing a plurality of types of raw material powders; for example, a first raw material powder and a second raw material powder. In this case, it is preferred to use, as the first raw material powder, a powder of metal that is harder than an aluminum alloy for casting and with which the heat resistance, wear resistance, and heat conductivity required for the valve seats can be obtained. For example, it is preferred to use the above-described precipitation-hardened copper alloy. On the other hand, it is preferred to use, as the second raw material powder, a powder of metal that is harder than the first raw material powder. The second raw material powder for application may be an alloy such as an iron-based alloy, a cobalt-based alloy, a chromium-based alloy, a nickel-based alloy, or a molybdenum-based alloy, ceramics, or the like. One type of these metals may be used alone, or two or more types may also be used in combination.

With the valve seat films formed of a mixture of the first raw material powder and the second raw material powder which is harder than the first raw material powder, more excellent heat resistance and wear resistance can be obtained than those of valve seat films formed only of a precipitation-hardened copper alloy. The reason that such an effect is obtained appears to be because the second raw material powder allows the oxide film existing on the surface of the cylinder head 12 to be removed so that a new interface is exposed and formed to improve the interfacial adhesion between the cylinder head 12 and the metal films. Additionally or alternatively, it appears that the anchor effect due to the second raw material powder sinking into the cylinder head 12 improves the interfacial adhesion between the cylinder head 12 and the metal films. Additionally or alternatively, it appears that when the first raw material powder collides with the second raw material powder, a part of the kinetic energy is converted into heat energy, or heat is generated in the process in which a part of the first raw material powder is plastically deformed, and such heat promotes the precipitation hardening in a part of the precipitation-hardened copper alloy used as the first raw material powder.

The cold spray apparatus 2 of the present embodiment may be used as follows. The cylinder head 12 to be formed with the valve seat films 16*b* and 17*b* is fixed to a base table 45, while the tip of the nozzle 23*d* of the spray gun 23 is rotated along the annular edge portions of the opening portions 16*a* and 17*a* of the cylinder head 12 to spray the raw material powder. The cylinder head 12 is not rotated, so it does not require a large occupied space, and the inertia moment of the spray gun 23 is smaller than that of the cylinder head 12, so it is excellent in the rotational transient characteristics and responsiveness. However, for the semi-manufactured cylinder head and the method of manufacturing a cylinder head of the present invention, the cylinder head 12 as the base material and the spray gun 23 need only move relative to each other; therefore, the nozzle 23*d* of the spray gun 23 may be fixed while the cylinder head 12 may be rotated and swung, or the cylinder head 12 may be rotated and swung together with the nozzle 23*d* of the spray gun 23.

Figure 4:
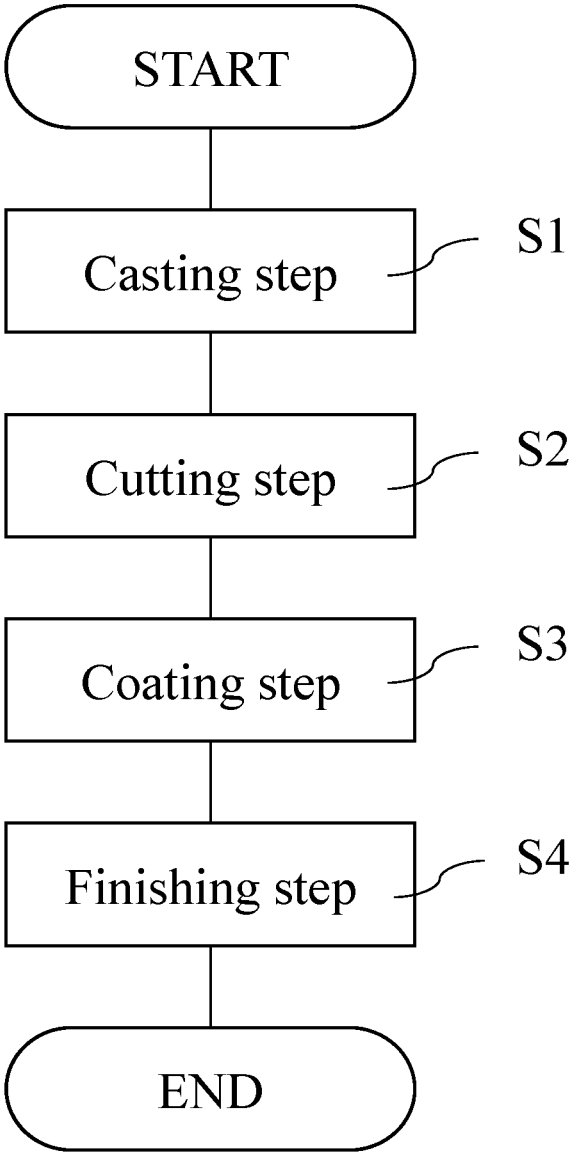
FIG. 4 is a process chart illustrating a procedure for manufacturing the cylinder head according to the present invention.

The description will then be directed to a method of manufacturing the cylinder head 12 including the valve seat films 16*b* and 17*b*. FIG. 4 is a process chart illustrating steps of processing the valve sites in the method of manufacturing the cylinder head 12 of the present embodiment. As illustrated in the figure, the method of manufacturing the cylinder head 12 of the present embodiment includes a casting step S1, a cutting step S2, a coating step S3, and a finishing step S4. Processing steps other than those for the valve sites will be omitted for simplicity of the description.

Figure 5:
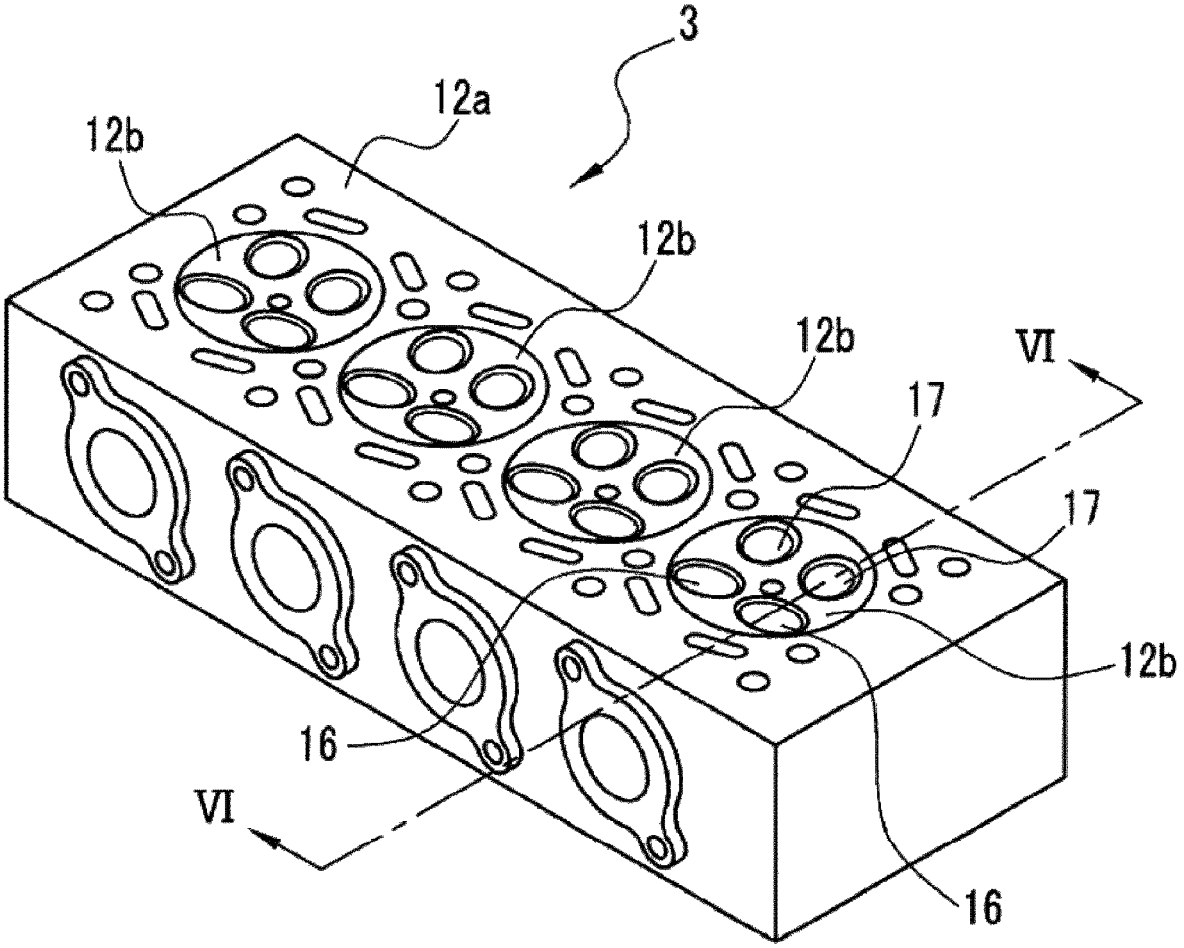
FIG. 5 is a perspective view illustrating the configuration of a semimanufactured cylinder head according to the present invention.

In the casting step S1, an aluminum alloy for casting is poured into a mold in which sand cores are set, and casting is performed to mold a semimanufactured cylinder head 3 having intake ports 16, exhaust ports 17, etc. formed in the main body portion. Here, the semimanufactured cylinder head 3 refers to a semi-finished product in middle of production before being processed into the cylinder head 12 as the final product. The intake ports 16 and the exhaust ports 17 are formed by the sand cores, and the recessed portions 12*b* are formed by the mold. FIG. 5 is a perspective view of the semimanufactured cylinder head 3 having been cast-molded in the casting step S1 as seen from above the mounting surface 12*a* to the cylinder block 11. The semi-manufactured cylinder head 3 has four recessed portions 12*b* that are each provided with two intake ports 16 and two exhaust ports 17. The two intake ports 16 and two exhaust ports 17 of each recessed portion 12*b* are merged into respective two in the semimanufactured cylinder head 3, which communicate with openings provided in both surfaces of the semimanufactured cylinder head 3.

Figure 6A:
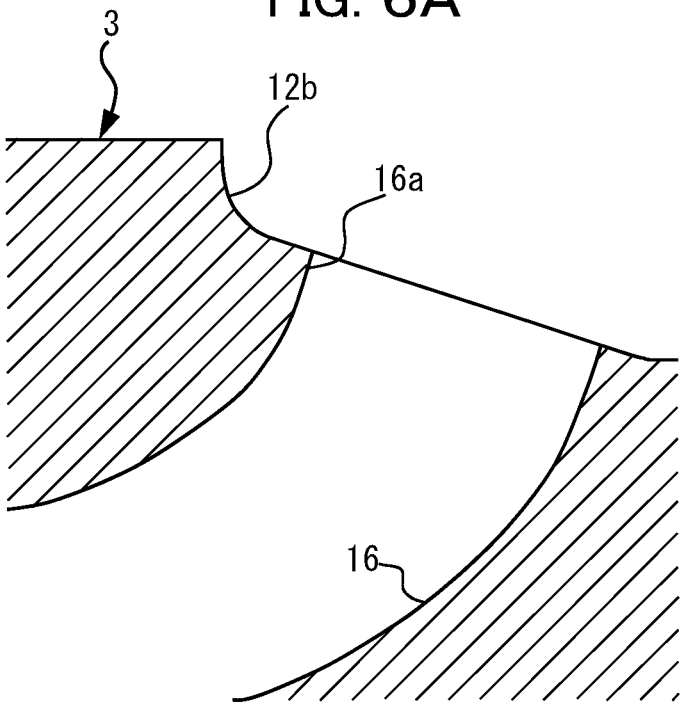
FIG. 6A is a cross-sectional view illustrating an intake port along line VI-VI of FIG. 5.

FIG. 6A is a cross-sectional view of the semimanufactured cylinder head 3 taken along line VI-VI of FIG. 5 and illustrates an intake port 16. The intake port 16 is provided with a circular opening portion 16*a* that is exposed in a recessed portion 12*b* of the semimanufactured cylinder head 3.

Figure 6B:
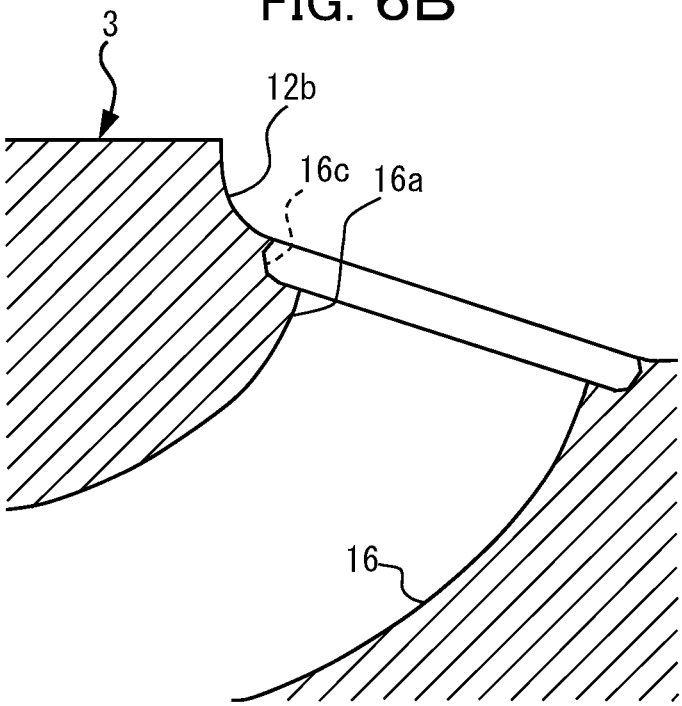
FIG. 6B is a cross-sectional view illustrating a state in which an annular valve seat portion is formed in the intake port of FIG. 6A in a cutting step.

In the subsequent cutting step S2, milling work is performed on the semimanufactured cylinder head 3 as illustrated in FIG. 6B, such as using an end mill or a ball end mill, to form an annular valve seat portion 16*c* in the opening portion 16*a* of the intake port 16. FIG. 6B is a cross-sectional view illustrating a state in which the annular valve seat portion is formed in the intake port of FIG. 6A in the cutting step. The annular valve seat portion 16*c* is an annular groove that serves as the base shape of a valve seat film 16*b*, and is formed on the outer circumference of the opening portion 16*a*. In the present embodiment, the annular valve seat portion 16*c* is applied as the film formation portion.

Figure 6C:
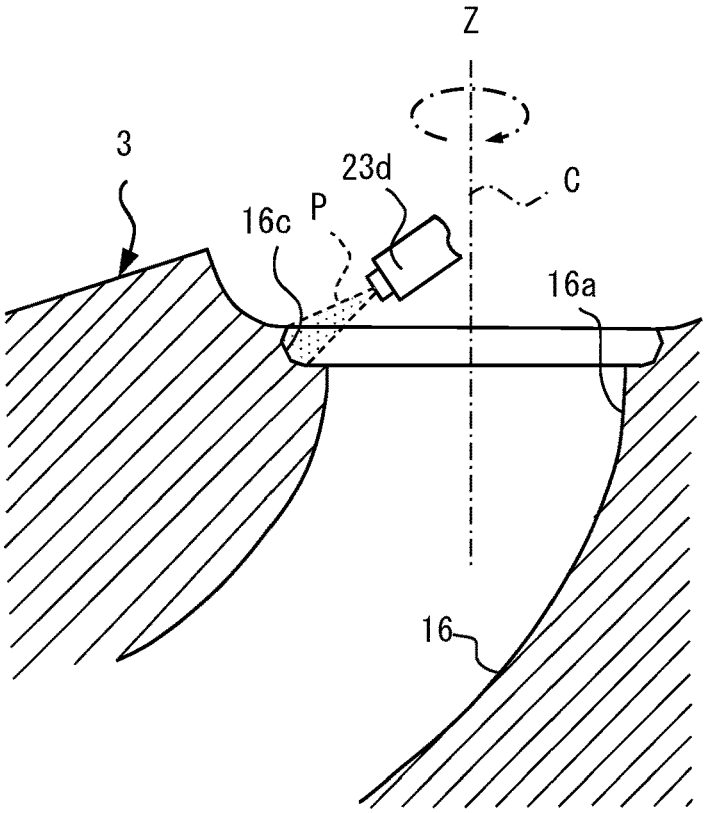
FIG. 6C is a cross-sectional view illustrating a state of forming a valve seat film in the intake port of FIG. 6B.
Figure 6D:
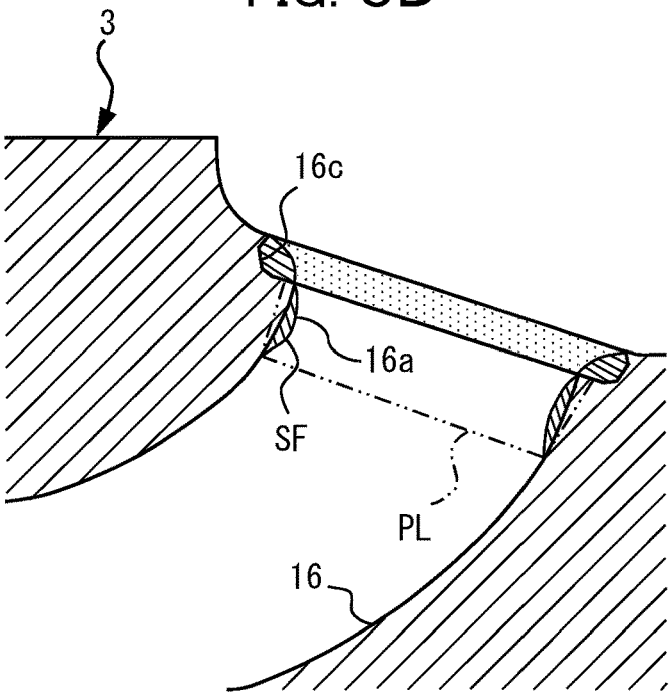
FIG. 6D is a cross-sectional view illustrating the intake port formed with the valve seat film.
Figure 6E:
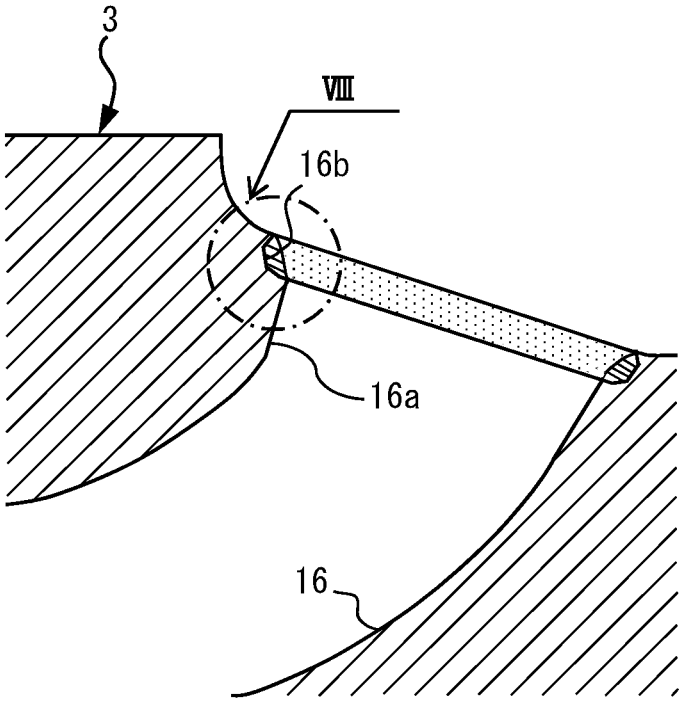
FIG. 6E is a cross-sectional view illustrating the intake port after a finishing step of FIG. 4.
Figure 6F:
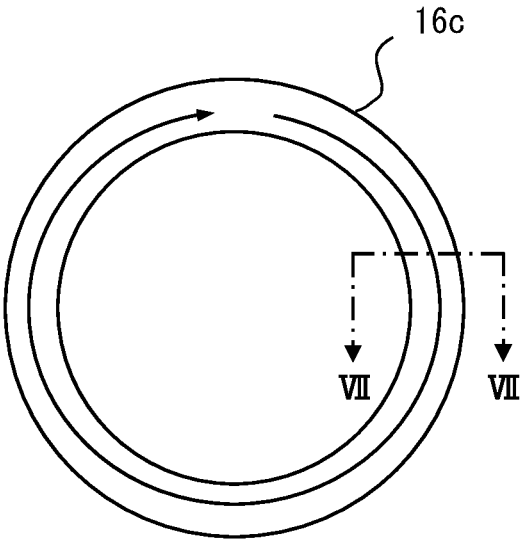
FIG. 6F is an enlarged plan view of the valve seat film of FIG. 6C.

In the method of manufacturing the cylinder head 12 according to the present embodiment, as illustrated in FIGS. 6C and 6F, the raw material powder P is sprayed along the annular valve seat portion 16*c* by using the cold spray method to form a film, and this film is used as a base to be processed into the valve seat film 16*b*. The annular valve seat portion 16*c* is therefore formed with a size slightly larger than that of the valve seat film 16*b*.

The valve seats formed by the cold spray method have an advantage that the heat resistance and wear resistance are excellent and the high heat conductivity can be obtained, while being required to have interfacial adhesion and high strength that can withstand the striking input from the intake and exhaust valves in the combustion chambers 15. To this end, in the method of manufacturing the cylinder head 12 according to the present embodiment, the annular valve seat portion 16*c* is formed such that, as illustrated in FIG. 6C, the cross-section along the radial direction of the annular valve seat portion 16*c* facing the nozzle 23*d* of the spray gun 23 of the cold spray apparatus 2 is in a groove shape.

Figure 7A:
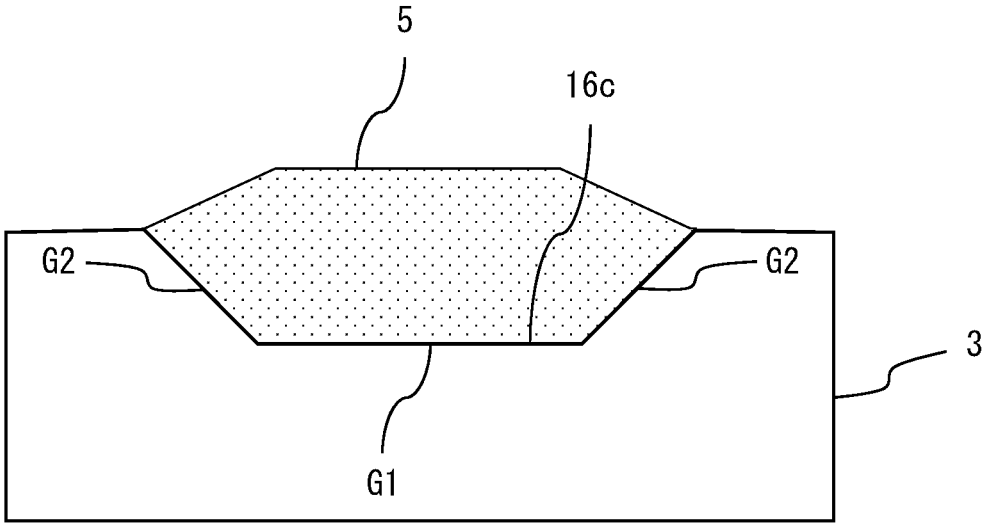
FIG. 7A is an enlarged cross-sectional view (part 1) illustrating an annular valve seat portion along line VII-VII of FIG. 6F.
Figure 7B:
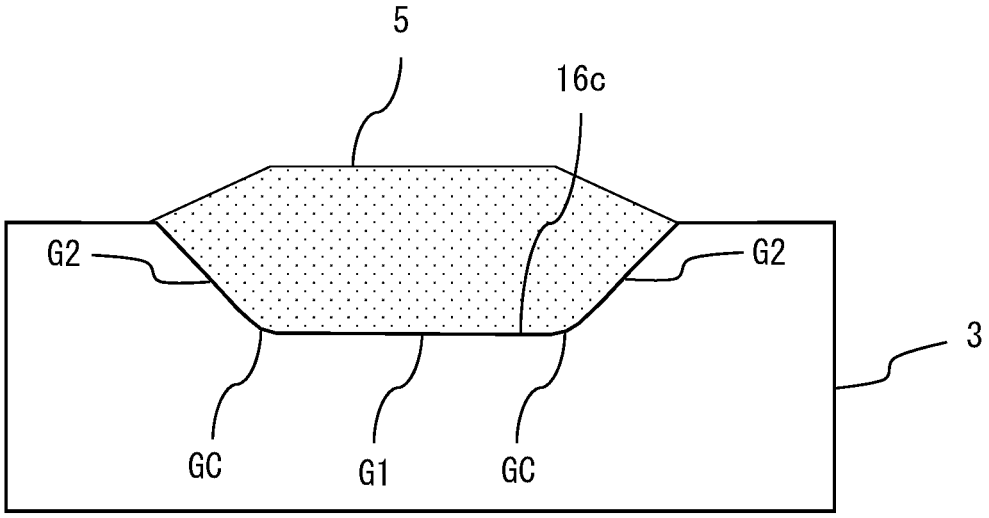
FIG. 7B is an enlarged cross-sectional view (part 2) illustrating the annular valve seat portion along line VII-VII of FIG. 6F.
Figure 7C:
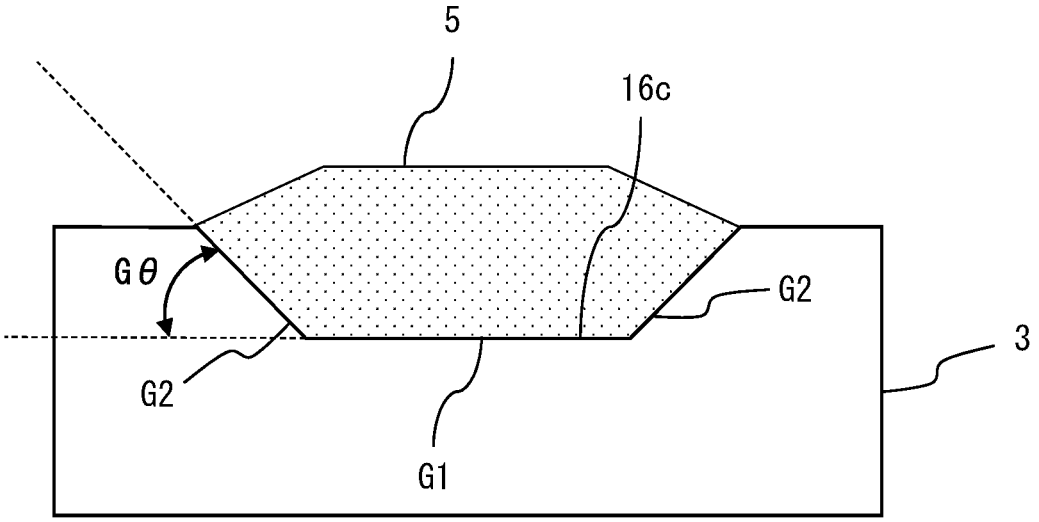
FIG. 7C is an enlarged cross-sectional view illustrating the annular valve seat along line VII-VII of FIG. 6F and is a cross-sectional view for describing a dihedral angle (groove angle) in a groove shape of the annular valve seat.

FIGS. 7A to 7C are enlarged cross-sectional views of the cross-sectional shape along the radial direction of the annular valve seat portion 16*c*. The radial direction of the annular valve seat portion refers to a direction that is perpendicular to the edge portion of the annular valve seat portion 16*c* formed along the circumferential direction of the opening portion 16*a* of the intake port 16, and the cross-sectional shape along the radial direction refers specifically to a cross-sectional shape along line VII-VII illustrated in FIG. 6F.

As illustrated in FIG. 7A, in the present embodiment, the cutting process is performed such that the cross-sectional shape along the radial direction of the annular valve seat portion 16*c* forms a recessed portion with respect to the semimanufactured cylinder head 3. More specifically, the site facing the nozzle 23*d* of the spray gun 23 of the cold spray apparatus 2 is formed in a groove shape including a flat bottom surface G1 and a pair of adjacent side surfaces G2. This allows the compressive residual stress of the metal film 5 formed by the cold spray method to act on the pair of side surfaces G2 of the groove shape, and it is therefore possible to manufacture the cylinder head 12 including the valve seat film 16*b* having excellent interfacial adhesion and high strength.

Figure 9:
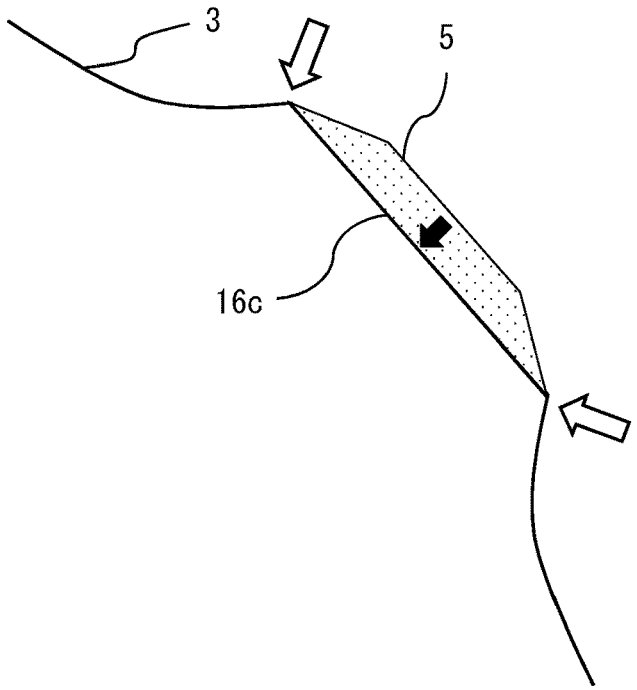
FIG. 9 is an enlarged cross-sectional view illustrating a film formation state of a valve seat film of a semimanufactured cylinder head according to a comparative example.

As illustrated in a comparative example of FIG. 9, for example, when the site facing the nozzle 23*d* of the spray gun 23 of the cold spray apparatus 2 is an annular valve seat portion 16*c* formed in a flat shape, the compressive residual stress (black arrow) of the metal film 5 acts toward the bottom surface of the metal film 5. On the other hand, the impact loads (white arrows) due to the striking input from the valve concentrate on the edge portions of the valve seat film 16*b*. Accordingly, the valve seat film 16*b* may crack near the edge portions or delaminate as the wear progresses.

Figure 8:
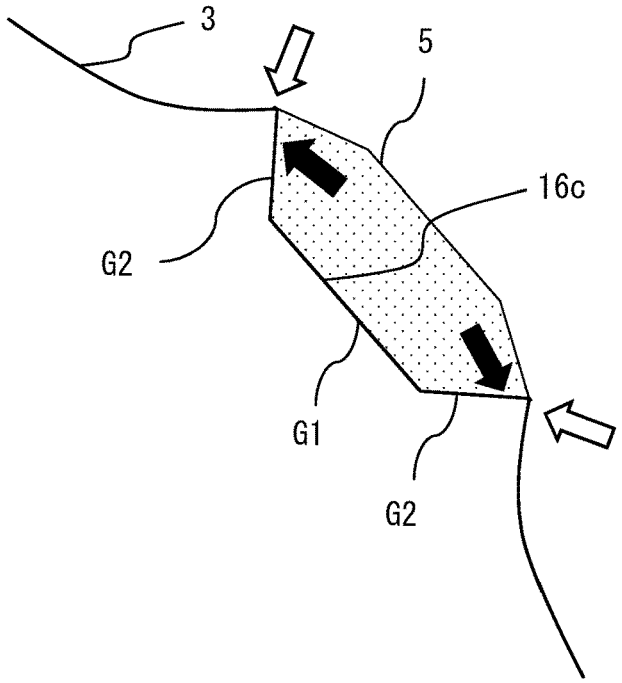
FIG. 8 is an enlarged cross-sectional view illustrating a film formation state of the valve seat film of the semimanufactured cylinder head according to the present invention, illustrating part VIII of FIG. 6E.

In contrast, as illustrated in FIG. 8, according to the annular valve seat portion 16*c* formed in a groove shape of the present embodiment, the compressive residual stresses (black arrows) of the metal film 5 fitted in the groove shape act on the side surfaces G2 and G2 of the groove shape against the impact loads (white arrows) from the valve concentrated on the edge portions of the valve seat film 16*b*. Thus, the compressive residual stresses of the metal film acting on the side surfaces G2 and G2 of the groove shape of the annular valve seat portion 16*c* counteract the impact loads due to the striking input from the valve, and the impact loads concentrated on the edge portions of the valve seat film 16*b* can therefore be reduced to suppress the cracking and delamination of the valve seat film 16*b*.

FIG. 7B is an enlarged cross-sectional view illustrating another embodiment of the cross-sectional shape along the radial direction of the annular valve seat portion 16*c*. In the present embodiment, boundary surfaces GC between the flat bottom surface G1 and the adjacent side surfaces G2 and G2 in the groove shape of the annular valve seat portion 16*c* are formed in a gentle arc shape. If the boundary surfaces GC between the flat bottom surface G1 and the side surfaces G2 and G2 are in a sharp shape, the impact loads due to the striking input from the valve concentrate on the ridgelines between the flat bottom surface G1 and the side surfaces G2 and G2. In contrast, when the boundary surfaces GC between the flat bottom surface G1 and the side surfaces G2 and G2 are formed in a gentle arc shape, the impact loads due to the striking input from the valve are distributed on the curved surfaces to alleviate the stress concentration, and the valve seat film 16*b* having higher strength can therefore be formed.

Moreover, when the boundary surfaces GC between the flat bottom surface G1 and the side surfaces G2 and G2 are formed in a gentle arc shape, the raw material powder P sprayed by the cold spray method adheres evenly to the boundary surfaces GC. This can enhance the interfacial adhesion of the valve seat film 16*b* formed on the annular valve seat portion 16*c*.

Figure 10:
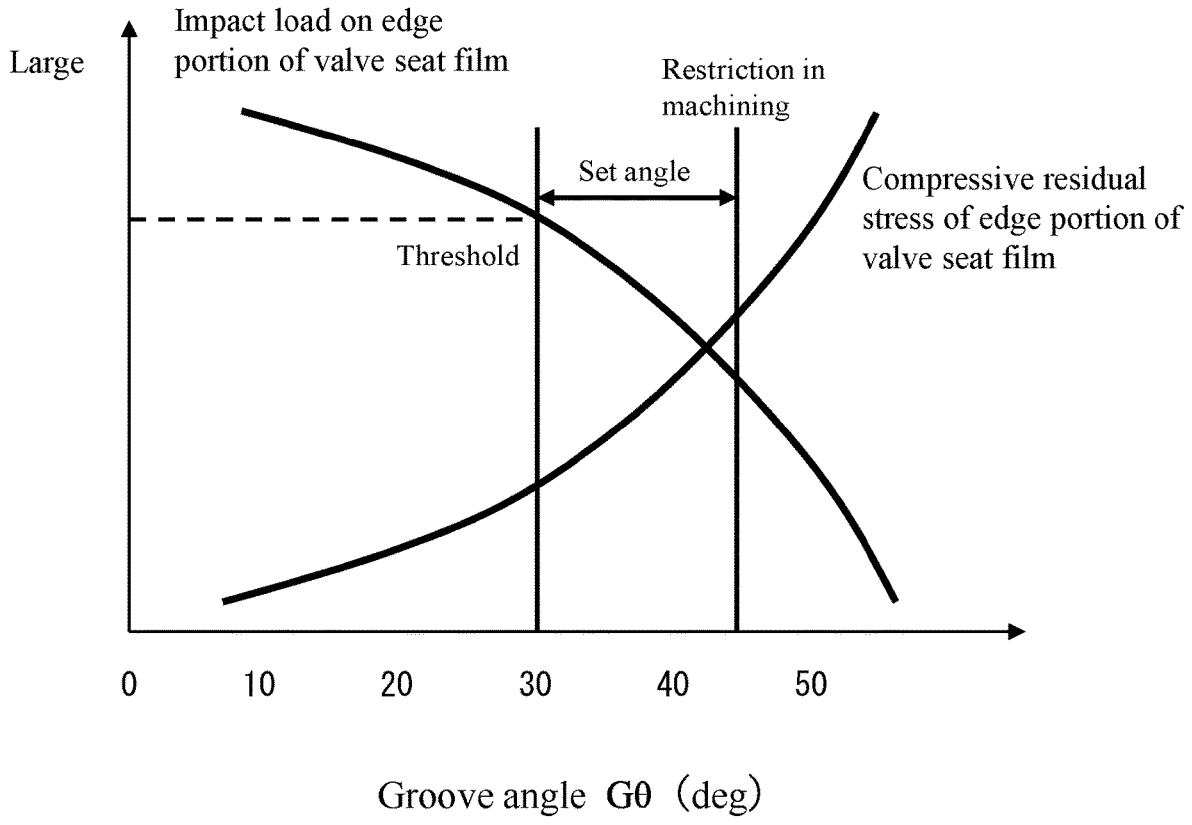
FIG. 10 is a graph illustrating the relationship between the stress acting on the valve seat film of the semimanufactured cylinder head according to the present invention and the dihedral angle (groove angle) in the groove shape of the annular valve seat portion.

FIG. 7C is a cross-sectional view illustrating a groove angle Gθ in the groove shape of the annular valve seat portion 16*c*, and FIG. 10 is a graph illustrating the relationship between the stress acting on the valve seat film 16*b* and the groove angle Gθ. The groove angle Gθ refers to an acute-side dihedral angle formed between the flat bottom surface G1 and one side surface G2 in the groove shape of the annular valve seat portion 16*c*.

As illustrated in FIG. 10, the smaller the groove angle Gθ in the groove shape of the annular valve seat portion 16*c*, the larger the impact loads (white arrows in FIG. 8) due to the striking input from the valve concentrated on the edge portions of the valve seat film 16*b*, while the larger the groove angle Gθ, the smaller the impact loads concentrated on the edge portions of the valve seat film 16*b*. Here, in the case of the groove angle Gθ<30°, cracks may occur in the valve seat film 16*b*; therefore, as a threshold value of the groove angle of the annular valve seat portion 16*c* for forming a valve seat that ensures the performance as a finished engine product, the groove angle Gθ≥30° is preferred.

On the other hand, the smaller the groove angle Gθ in the groove shape of the annular valve seat portion 16*c*, the smaller the compressive residual stresses (black arrows in FIG. 8) acting on the edge portions of the valve seat film 16*b*, while the larger the groove angle Gθ, the larger the compressive residual stresses acting on the edge portions of the valve seat film 16*b*. Thus, the larger the groove angle Gθ, the more excellent the interfacial adhesion of the valve seat film 16*b*. However, after forming the annular valve seat portion 16*c* and spraying the raw material powder P by the cold spray method to form a film, a finishing process is performed in the finishing step to be describe later in which a ball end mill is inserted in the intake port 16 to cut the inner surface on the opening portion 16*a* side. In this operation, if the groove angle Gθ is larger than 45°, the edge portion of the valve seat film 16*b* may interfere with the ball end mill, resulting in a disadvantage that the machining process cannot be performed. Therefore, as a value of the groove angle of the annular valve seat portion 16*c* for not being restricted by the finishing process, the groove angle Gθ≤45° is preferred.

Thus, by setting the groove angle Gθ in the groove shape of the annular valve seat portion 16*c* to 30°≤Gθ≤45°, it is possible to form the valve seat film 16*b* having higher strength, which is not subject to restrictions in the manufacturing steps after film formation and can suppress the occurrence of cracks due to the concentration of the impact loads on the edge portions of the valve seat film 16*b*.

The groove angle Gθ in the groove shape may have to be 30°≤Gθ≤45° only on one side in the radial direction of a tool and is not restricted on the other side during the machining, so the groove angle may be outside the above range on the other side.

Referring again to FIG. 4, in the coating step S3, the raw material powder P is sprayed onto the annular valve seat portion 16*c* of the semimanufactured cylinder head 3 by using the cold spray apparatus 2 of the present embodiment to form the valve seat film 16*b*. More specifically, in the coating step S3, as illustrated in FIG. 6C, the semimanufactured cylinder head 3 is fixed and the spray gun 23 is rotated so that the raw material powder P is sprayed onto the entire circumference of the annular valve seat portion 16*c* while keeping the same postures of the annular valve seat portion 16*c* and the nozzle 23*d* of the spray gun 23 and keeping constant the distance between the annular valve seat portion 16*c* and the nozzle 23*d*. FIG. 6C is a cross-sectional view illustrating a state of forming the valve seat film 16*b* in the intake port 16 of FIG. 6B.

The tip of the nozzle 23*d* of the spray gun 23 is held by the hand of an industrial robot above the cylinder head 12 fixed to a base table. The base table or the industrial robot sets the position of the cylinder head 12 or the spray gun 23 so that the central axis Z of the intake port 16 to be formed with the valve seat film 16*b* is vertical and overlaps the rotation axis of the spray gun 23. In this state, the spray gun 23 is rotated around the rotation axis while spraying the raw material powder P from the nozzle 23*d* onto the annular valve seat portion 16*c*, thereby forming a film on the entire circumference of the annular valve seat portion 16*c*.

While the coating step S3 is being carried out, the nozzle 23*d* introduces the coolant supplied from the coolant circulation circuit 27 into the flow channel through the coolant introduction port 23*e*. The coolant cools the nozzle 23*d* while flowing from the tip side to the rear end side of the flow channel formed inside the nozzle 23*d*. The coolant that has flowed to the rear end side of the flow channel is discharged from the channel through the coolant discharge port 23*f* and recovered.

When the spray gun 23 makes one rotation around the rotation axis to complete the formation of the valve seat film 16*b*, the rotation of the spray gun 23 is temporarily stopped. During this stop of rotation, the industrial robot to which the spray gun 23 is attached moves the spray gun 23 so that the central axis Z of another intake port 16 to be subsequently formed with the valve seat film 16*b* coincides with the reference axis of the industrial robot. Then, after the industrial robot completes the movement of the spray gun 23, the rotation of the spray gun 23 is resumed to form the valve seat film 16*b* in the next intake port 16. This operation is then repeated thereby to form the valve seat films 16*b* and 17*b* for all the intake ports 16 and exhaust ports 17 of the semimanufactured cylinder head 3.

Figure 11:
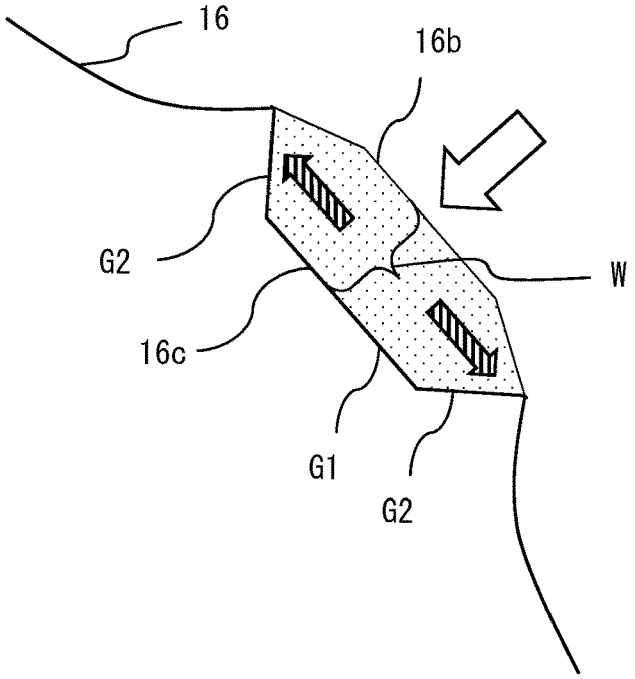
FIG. 11 is a cross-sectional view illustrating the relationship between the film thickness of the valve seat film of the semimanufactured cylinder head according to the present invention and the shear force due to the combustion pressure.
Figure 12:
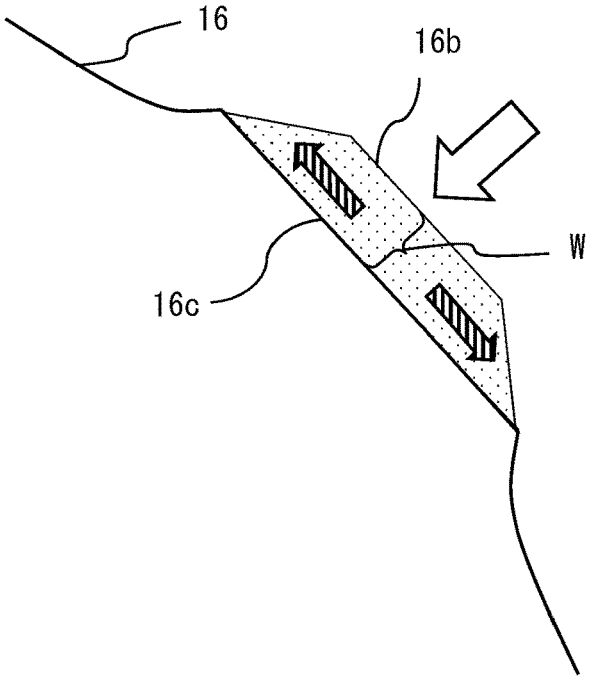
FIG. 12 is a cross-sectional view illustrating the relationship between the film thickness of the valve seat film of the semimanufactured cylinder head according to the comparative example and the shear force due to the combustion pressure.

FIG. 11 is a cross-sectional view illustrating the relationship between the film thickness of the valve seat film 16*b* of the cylinder head 12 according to the present invention and the shear force due to the combustion pressure of the engine. The shear force (hatched arrows) due to combustion pressure (white arrow) generated in the combustion chamber 15 acts outward in the valve seat film 16*b*, and stresses are concentrated on the edge portions. Here, as illustrated in FIG. 11, when the annular valve seat portion 16*c* is in a groove shape and, as a result, the film thickness W of the valve seat film 16*b* is large, the shear force due to the combustion pressure acts mainly on the side surfaces G2 and G2 of the groove shape of the annular valve seat portion 16*c*. On the other hand, as illustrated in a comparative example of FIG. 12, when the annular valve seat portion 16*c* is in a flat shape and the film thickness W of the valve seat film 16*b* is small, the shear force (hatched arrows) due to the combustion pressure (white arrow) acts on the entire bottom surface of the valve seat film 16*b*.

According to the valve seat film 16*b* formed based on the groove shape of the annular valve seat portion 16*c* of the present embodiment, even when the shear force acts on the valve seat film 16*b* due to the combustion pressure of the engine, this force can be received by the side surfaces G2 and G2 of the groove shape. Although the film thickness W of the valve seat film 16*b* is not particularly limited, the film thickness W suitable for the groove shape of the annular valve seat portion 16*c* according to the present embodiment is preferably 300 μm to 1500 μm. This allows the side surfaces G2 and G2 of the groove shape to receive the shear force due to the combustion pressure which tends to concentrate on the edge portions of the valve seat film 16*b*, and it is therefore possible to manufacture a cylinder head including the valve seat film 16*b* having higher strength.

Referring again to FIG. 4, in the finishing step S4, a finishing process is performed on the valve seat films 16*b* and 17*b*, the intake ports 16, and the exhaust ports 17. In the finishing process performed on the valve seat films 16*b* and 17*b*, the surfaces of the valve seat films 16*b* and 17*b* are cut by milling work using a ball end mill to adjust the valve seat films 16*b* into a predetermined shape. In the finishing process performed on an intake port 16, a ball end mill is inserted from the opening portion 16*a* into the intake port 16 to cut the inner surface of the intake port 16 on the opening portion 16*a* side along a working line PL illustrated in FIG. 6D. FIG. 6D is a cross-sectional view illustrating the intake port formed with the valve seat film 16*b*. The working line PL defines a range in which the raw material powder P scatters and adheres in the intake port 16 to form a relatively thick excessive film SF. More specifically, the working line PL refers to a range in which the excessive film SF is formed thick to such an extent that affects the intake performance of the intake port 16.

Thus, according to the finishing step S4, the surface roughness of the intake port 16 due to the cast molding is eliminated, and the excessive film SF formed in the coating step S3 can be removed. FIG. 6E is a cross-sectional view illustrating the intake port 16 after the finishing step of FIG. 4. Like the intake ports 16, each exhaust port 17 is processed through the formation of a small diameter portion in the exhaust port 17 by the cast molding, the formation of an annular valve seat portion by the cutting process, the cold spray onto the annular valve seat portion, and the finishing process performed on the valve seat film 17*b*. Detailed description will therefore be omitted for the procedure of forming the valve seat films 17*b* in the exhaust ports 17.

As described above, according to the semimanufactured cylinder head and the method of manufacturing a cylinder head of the present embodiment, the cross-sectional shape along the radial direction of the annular valve seat portion 16*c* is formed in a groove shape including the flat bottom surface G1 and the pair of adjacent side surfaces G2, and the compressive residual stresses of the metal film 5 act on the pair of side surfaces G2 of the groove shape; therefore, it is possible to manufacture the cylinder head 12 including the valve seat film 16*b* having excellent interfacial adhesion and high strength.

Moreover, according to the semimanufactured cylinder head and the method of manufacturing a cylinder head of the present embodiment, the compressive residual stresses of the metal film 5 acting on the side surfaces G2 and G2 of the groove shape of the annular valve seat portion 16*c* counteract the impact loads due to the striking input from the valve, and the impact loads concentrating on the edge portions of the valve seat film 16*b* can therefore be reduced to suppress the cracking and delamination of the valve seat film 16*b*.

Furthermore, according to the semimanufactured cylinder head and the method of manufacturing a cylinder head of the present embodiment, the boundary surfaces GC between the flat bottom surface G1 and the side surfaces G2 and G2 in the groove shape of the annular valve seat portion 16*c* are formed in a gentle arc shape, and the impact loads due to the striking input from the valve are thereby distributed on the curved surfaces to alleviate the stress concentration; therefore, the valve seat film 16*b* having higher strength can be formed.

In addition, according to the semimanufactured cylinder head and the method of manufacturing a cylinder head of the present embodiment, the boundary surfaces GC between the flat bottom surface G1 and the side surfaces G2 and G2 in the groove shape of the annular valve seat portion 16*c* are formed in a gentle arc shape, and the raw material powder P sprayed using the cold spray method thereby adheres evenly to the boundary surfaces GC; therefore, it is possible to enhance the interfacial adhesion of the valve seat film 16*b* formed on the annular valve seat portion 16*c*.

Moreover, according to the semimanufactured cylinder head and the method of manufacturing a cylinder head of the present embodiment, the groove angle Gθ, which is an acute-side dihedral angle formed between the flat bottom surface G1 and one side surface G2 in the groove shape of the annular valve seat portion 16*c*, is set to 30°≤Gθ≤45°, and it is therefore possible to form the valve seat film 16*b* having higher strength, which is not subject to restrictions in the manufacturing steps after film formation and can suppress the occurrence of cracks due to the concentration of the impact loads on the edge portions of the valve seat film 16*b*.

The groove angle Gθ in the groove shape may have to be 30°≤Gθ≤45° only on one side in the radial direction of a tool and is not restricted on the other side during the machining, so the groove angle may be outside the above range on the other side.

Furthermore, according to the semimanufactured cylinder head and the method of manufacturing a cylinder head of the present embodiment, the film thickness W of the valve seat film 16*b* is 300 μm to 1500 μm, and the side surfaces G2 and G2 of the groove shape can receive the shear force due to the combustion pressure which tends to concentrate on the edge portions of the valve seat film 16*b*; therefore, it is possible to manufacture a cylinder head including the valve seat film 16*b* having higher strength.

DESCRIPTION OF REFERENCE NUMERALS

1 Internal-combustion engine
- 11 Cylinder block
- 11*a* Cylinder
- 12 Cylinder head
- 12*a* Mounting surface
- 12*b* Recessed portion
- 12*c*, 12*d* Side surface
- 13 Piston
- 13*a* Connecting rod
- 13*b* Top surface
- 14 Crankshaft
- 15 Combustion chamber
- 16 Intake port
- 16*a* Opening portion
- 16*b* Valve seat film
- 16*c* Annular valve seat portion
- 17 Exhaust port
- 17*a* Opening portion
- 17*b* Valve seat film
- 18 Intake valve
- 18*a* Valve stem
- 18*b* Valve head
- 18*c* Valve guide
- 19 Exhaust valve
- 19*a* Valve stem
- 19*b* Valve head
- 19*c* Valve guide

2 Cold spray apparatus
- 21 Gas supply unit
- 21*a* Compressed gas cylinder
- 21*b* Operation gas line
- 21*c* Carrier gas line
- 21*d* Pressure regulator
- 21*e* Flow rate control valve
- 21*f* Flow meter
- 21*g* Pressure gauge
- 21*h* Power source
- 21*i* Heater
- 22 Raw material powder supply unit
- 22*a*, 221*a*, 222*a* Raw material powder supply device
- 22*b* Weighing machine
- 22*c*, 221*c*, 222*c* Raw material powder supply line
- 22*d* Partition
- 23 Spray gun
- 23*a* Chamber
- 23*b* Pressure gauge
- 23*c* Thermometer
- 23*d* Nozzle
- 23*e* Coolant introduction port
- 23*f* Coolant discharge port
- 23*g*, 23*h* Signal line
- 27 Coolant circulation circuit
- 271 Tank
- 272 Pump
- 273 Cooler
- 274 Introduction pipe
- 275 Discharge pipe

3 Semimanufactured cylinder head
4 Base material
5 Metal film
G1 Bottom surface
G2 Side surface
GC Boundary surface
Gθ Groove angle
P Raw material powder
SF Excessive film

The invention claimed is:

1. A semimanufactured cylinder head comprising a main body portion that comprises:
- a port for intake or exhaust having an opening portion;
- a film formation portion formed on an annular edge portion along the opening portion; and
- a metal film formed on the film formation portion, wherein:
- the film formation portion comprises, in a cross section along a radial direction of the port, a flat bottom surface, a pair of side surfaces adjacent to the bottom surface, and arc-shaped boundary surfaces that connect the bottom surface and the pair of side surfaces, wherein the flat bottom surface, the pair of side surfaces, and the arc-shaped boundary surfaces define a groove shape, and
- the metal film is formed so as to have compressive residual stress that acts on the pair of side surfaces, wherein the metal film presses against the pair of side surfaces.

2. The semimanufactured cylinder head according to claim 1, wherein:
- a groove angle, which is an acute-side dihedral angle formed between the bottom surface and any one of the pair of side surfaces, is in a range of 30 degrees to 45 degrees.

3. The semimanufactured cylinder head according to claim 1, wherein:
- the metal film formed on the film formation portion has a film thickness in a range of 300 μm to 1500 μm.

4. The semimanufactured cylinder head according to claim 2, wherein:
- the metal film formed on the film formation portion has a film thickness in a range of 300 μm to 1500 μm.

5. The semimanufactured cylinder head of claim 1, wherein:
- the metal film is a cold-sprayed metal film.

6. The semimanufactured cylinder head of claim 1, wherein:
- the metal film is a precipitation-hardened copper alloy.

7. The semimanufactured cylinder head of claim 1, wherein:

the metal film is a cold-sprayed precipitation-hardened copper alloy.

8. The semimanufactured cylinder head of claim 1, wherein:

the metal film is formed as a single layer.

* * * * *